US008743012B2

(12) United States Patent
Kenoun

(10) Patent No.: US 8,743,012 B2
(45) Date of Patent: Jun. 3, 2014

(54) BROAD-BAND, MULTI-BAND ANTENNA

(75) Inventor: Robert Kenoun, Sunnyvale, CA (US)

(73) Assignee: Qualcomm Incorporated, San Diego, CA (US)

( * ) Notice: Subject to any disclaimer, the term of this patent is extended or adjusted under 35 U.S.C. 154(b) by 204 days.

(21) Appl. No.: 13/274,910

(22) Filed: Oct. 17, 2011

(65) Prior Publication Data

US 2013/0093636 A1 Apr. 18, 2013

(51) Int. Cl.
*H01Q 7/00* (2006.01)

(52) U.S. Cl.
USPC ..... 343/866; 343/867; 343/741; 343/742

(58) Field of Classification Search
USPC ..... 343/749, 725, 866, 867, 841, 842
See application file for complete search history.

(56) References Cited

U.S. PATENT DOCUMENTS 7,265,726 B2 * 9/2007 Kenoun et al. ..... 343/725
7,812,774 B2 10/2010 Friman et al.
2009/0267843 A1 * 10/2009 Wu et al. ..... 343/702
2009/0273530 A1 11/2009 Chi et al.
2011/0012790 A1 1/2011 Badaruzzaman et al.
2011/0109515 A1 5/2011 Rao

FOREIGN PATENT DOCUMENTS

JP 2007067884 3/2007

OTHER PUBLICATIONS

Chiu, C.W, et al, "A Meandered Loop Antenna for LTE/WWAN Operations in a Smart Phone", Progress in Electromagnetics Research C, V.16, pp. 147-160, 2010.

* cited by examiner

*Primary Examiner* — Dieu H. Duong
*Assistant Examiner* — Hai Tran
(74) *Attorney, Agent, or Firm* — Kilpatrick Townsend and Stockton LLP

(57) ABSTRACT

A broad-band, multi-band antenna. The antenna includes a ground terminal and a feed terminal, an elongated inductor, a first inductive element electrically coupled between the ground terminal and a first extremity of the elongated inductor, a capacitive element in parallel connection with the first inductive element, and a second inductive element electrically coupled between a second extremity of the elongated inductor and the feed terminal.

10 Claims, 11 Drawing Sheets

BROAD-BAND, MULTI-BAND ANTENNA

BACKGROUND

Current and next-generation portable appliances such as mobile telephones need antennas characterized by good broad-band and multi-band performance, especially with the spreading adoption of fourth-generation long-term evolution (4G LTE) technology. Antenna bandwidth requirements have increased with this technology because frequency bands of 0.7 GHz are specified for 4G LTE and antennas must perform in these bands as well as in existing 0.85, 0.90 and 1.9 GHz bands.

BRIEF DESCRIPTION OF THE DRAWINGS

The drawings illustrate by example aspects and implementations of the invention.

DETAILED DESCRIPTION

Figure 1:
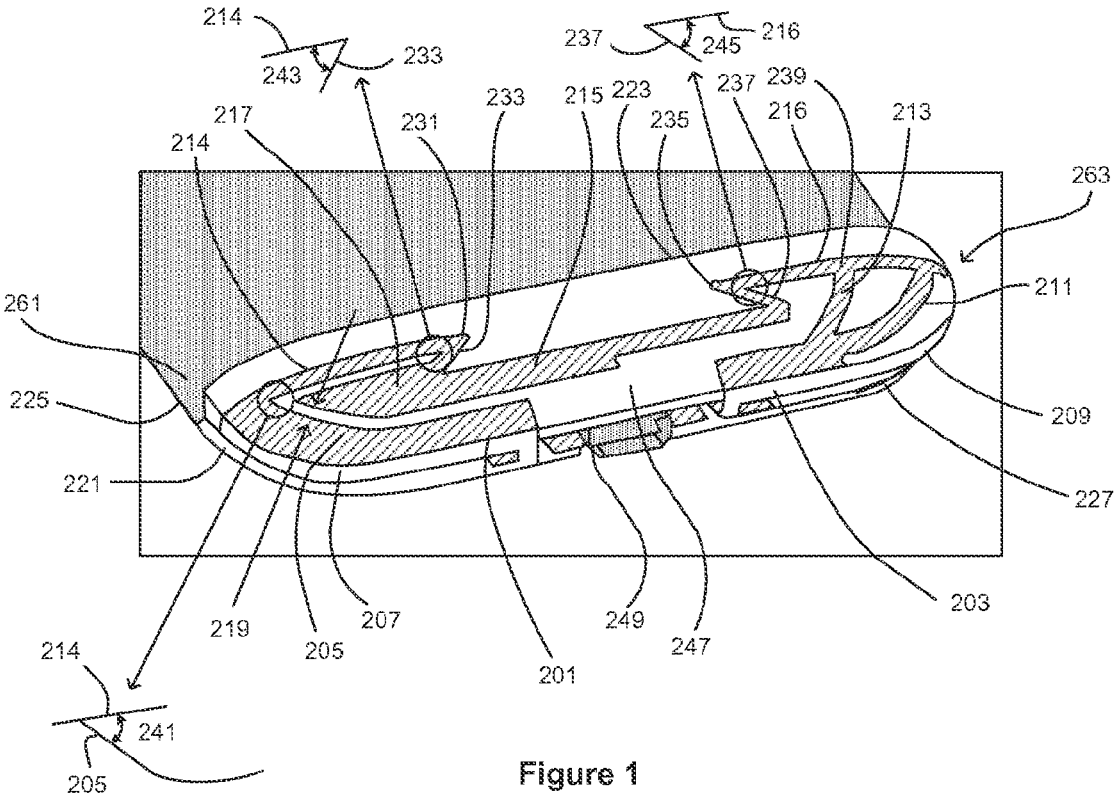
FIG. 1 is a perspective view of a broad-band, multi-band antenna embodying principles of the invention.

In the drawings and in this description, examples and details are used to illustrate principles of the invention. However, other configurations may suggest themselves, and the invention may be practiced without limitation to the details and arrangements as described. Also, some known methods and structures have not been described in detail in order to avoid obscuring the invention. The invention is to be limited only by the claims, not by the drawings or this description.

Any component values, any dimensions, and any electrical parameters are approximate and may be modified without departing from the scope of the invention. Terms of orientation such as "top" and "bottom" are used only for convenience to indicate spatial relationships of components with respect to each other; except as otherwise indicated, orientation is not critical to proper functioning of the invention.

Loop antennas of the kind commonly used in mobile phones have two resonance frequencies, permitting operation in two different frequency bands. Changing the length of the loop changes both resonance frequencies in the same direction, limiting any effort to tune the antenna to different frequency bands. Accordingly there is a need for an antenna that is physically configured for use in a mobile telephone or other portable device and that can operate in existing frequency bands such as the 0.85, 0.90, and 1.9 GHz frequency bands and in the new 4G LTE 0.7 GHz frequency band as well.

As to be described in more detail while discussing FIG. 1, at frequencies falling within a first one of the bands of the antenna, a high-impedance path is defined between the elongated inductor and the ground terminal by the capacitive element and the first inductive element, whereby the inductors of the second inductive element define monopole radiating elements. At frequencies falling within a second one of the bands of the antenna, conducting paths are defined through the first inductive element between the elongated inductor and the ground terminal, whereby each inductor of the first inductive element defines, through the elongated inductor, loop antennas with each inductor of the second inductive element.

For convenience, some other component may be disposed on the circuit board in a space between the feed and ground terminals described below in FIG. 1. For example, a USB connector may be disposed in this space, but the USB connector is not necessary for proper operation of the antenna. Also, a component, for example a loudspeaker, may be disposed in a space between the extremities of the conductor, but again this is not needed for proper antenna operation.

An antenna embodying principles of the invention will now be described with reference to FIG. 1. The antenna includes a ground terminal 201 and a feed terminal 203. First and second arcuate inductors 205 and 207 have proximal ends connected to the ground terminal. Third, fourth and fifth arcuate inductors 209, 211 and 213 have proximal ends connected to the feed terminal. Distal ends of the first and second arcuate inductors are joined to form a first common section 214. Distal ends of the third, fourth and fifth arcuate inductors are joined to form a second common section 216. An elongated inductor 215 extends between the first common section 214 and the second common section 216. A coupling section 217 of the elongated inductor is disposed generally parallel with and spaced apart from the first arcuate inductor 205 and the first common section 214 to define a gap 219 therebetween.

The antenna includes a circuit board 221 and a non-conducting frame 223 carried by the circuit board. A ground plane 225 covers a portion of the circuit board. The ground terminal is electrically connected to the ground plane. The first and second arcuate inductors are disposed on the frame adjacent the ground plane, and the third, fourth and fifth arcuate inductors are disposed on the frame adjacent a portion 227 of the circuit board not covered by the ground plane.

A capacitance is formed across the gap 219. At frequencies falling within a first one of the bands of the antenna, a high-impedance path is defined between the elongated inductor and the ground terminal, whereby the third, fourth, and fifth arcuate inductors define monopole radiating elements. At frequencies falling within a second one of the bands of the antenna, conducting paths are defined through the first and second arcuate inductors between the elongated inductor and the ground terminal, whereby the first arcuate inductor through the elongated inductor defines loop antennas with each of the third, fourth, and filth arcuate inductors and the second arcuate inductor through the elongated inductor defines loop antennas with each of the third, fourth, and fifth arcuate inductors.

A first extremity 231 of the elongated inductor is defined by a first connecting section 233. A second extremity 235 of the elongated inductor is defined by a second connecting section 237. The coupling section 217 is disposed between the first and second connecting sections.

In some embodiments the first common section 214 joins the first arcuate inductor 205 at an acute angle 241. Similarly, the first common section 214 joins the first connecting section 233 at an acute angle 243, and the second common section 216 joins the second connecting section 237 at an acute angle 245. This geometry including the acute angles was used to increase the length of the elongated inductor, and thereby of the loops of which it is a part, so as to lower the resonant frequencies of the loops. A wider antenna frame would allow for an antenna of the same length without the acute angles and the resulting zig-zag shape of the antenna.

The frame 223 may have a planar surface 247 and an edge surface 249. The frame supports the arcuate inductors and the elongated inductor.

Figure 2:
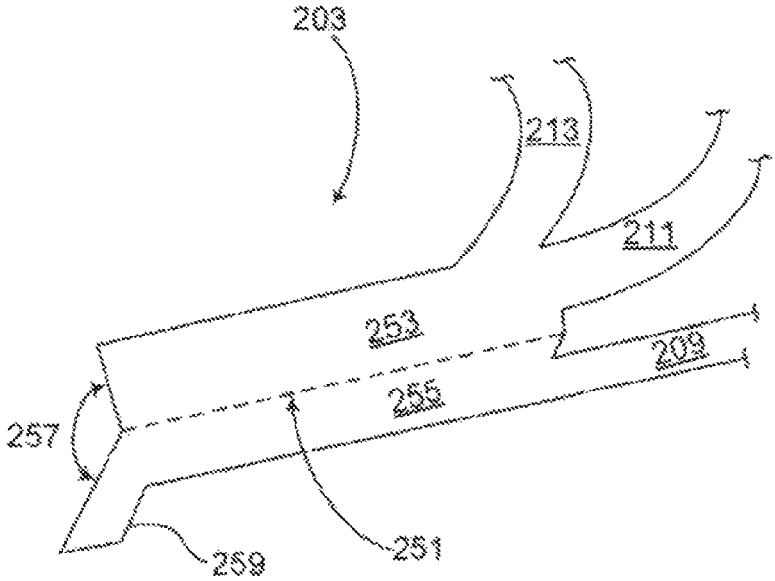
FIG. 2 is a detail view of an element of the antenna shown in FIG. 1.

As shown in FIG. 2, in some embodiments the feed terminal 203 comprises a conducting strip creased along a longitudinal axis 251 to define a first section 253 and a second section 255. An angle 257 is defined between the first and section sections. The second section may include a tab 259 that connects with circuitry (not shown) on the circuit board. The first section 253 is carried on the planar surface 247 of the frame, and the second section 255 is carried on the edge surface 249 of the frame. The ground terminal 201 may be similarly configured.

The planar surface 247 of the frame may carry at a first end 261 the first arcuate inductor 205, the first common section 214, the first connecting section 233, and a portion of the coupling section 217. Ata second end 263, the planar surface of the frame carries the fourth and fifth arcuate inductors 211 and 213, the second common section 216, the second connecting section 237, and a portion of the coupling section. The edge surface 249 of the frame may carry the second arcuate inductor 207 at the first end 261 of the frame and the third arcuate inductor 209 at the second end 263 of the frame.

Figure 3:
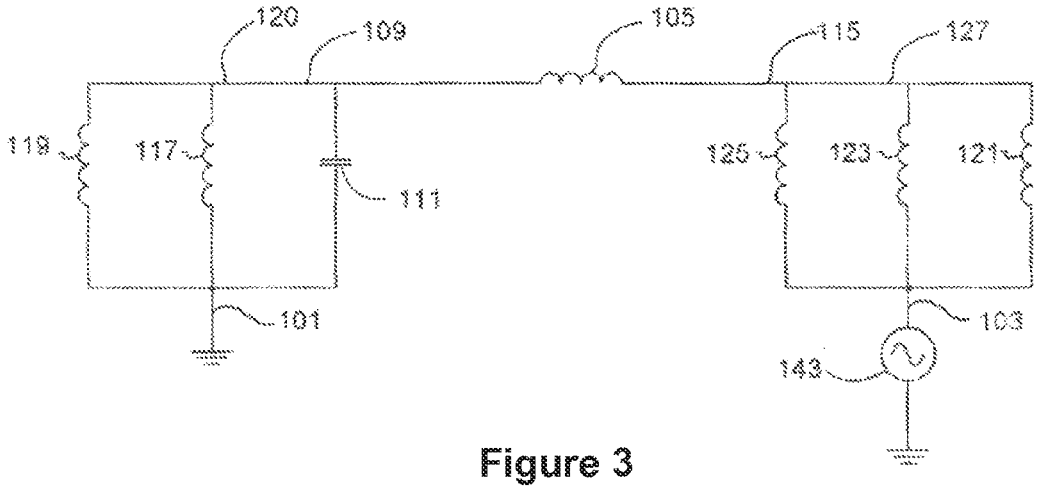
FIG. 3 is a schematic diagram of elements of the antenna shown in FIG. 1.

Operation of the antenna will now be explained. FIG. 3 shows a schematic representation of the elements of the antenna of FIG. 1. Several elements of the antenna of FIG. 3 correspond with elements of FIG. 1, and these corresponding elements will be discussed together. The antenna is driven by circuitry (not shown) that is represented by a source 143. The source 143 connects at the feed terminal 103 to the traces 121, 123 and 125 of the second inductive element. These traces are represented in FIG. 3 as inductors. The traces 121, 123, and 125 correspond with the arcuate inductors 209, 211, and 213, respectively, of FIG. 1. Feed terminal 103 corresponds to feed terminal 203 of FIG. 1.

The traces 121, 123 and 125 connect through the trace 127 to the second extremity 115 of the elongated inductor 105. The first extremity 109 of the elongated inductor connects to the third trace 120 of the first inductive element 107. The capacitive element 111 is formed as a distributed capacitor across the gap between the trace 117 of the first inductive element (traces 117 and 119) and the coupling section 129 of the elongated inductor. The capacitor and the traces 117 and 119 connect to ground through the ground terminal 101. The traces 117 and 119 are represented as inductors in FIG. 3. These two traces correspond with the arcuate inductors 205 and 207, respectively, of FIG. 1. Ground terminal 101, trace 120, trace 127, first extremity 109, second extremity 115, elongated inductor 105, capacitive element 111, and coupling section 129 corresponds to ground terminal 202, first common section 214, second common section 216, first extremity 231, second extremity 235, elongated inductor 215, capacitive element 219, and coupling section 217, respectively, of FIG. 1.

Figure 4:
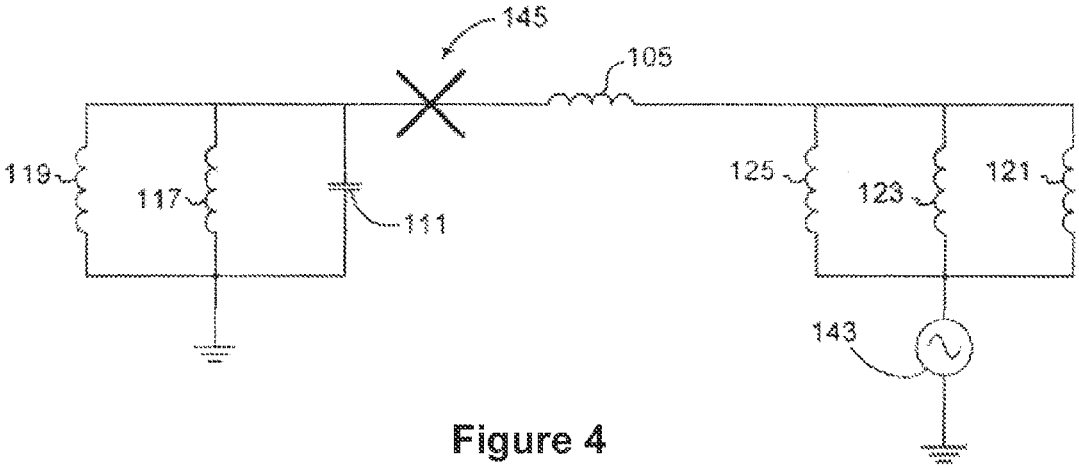
FIG. 4 is a schematic similar to FIG. 3 but showing effects of operation at a relatively high frequency.
Figure 5:
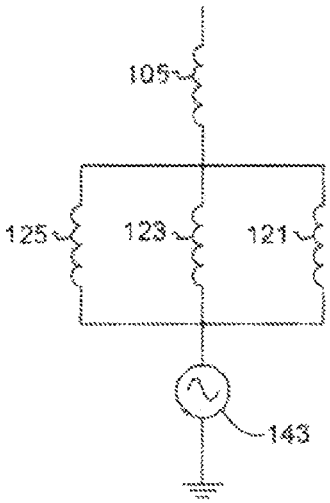
FIG. 5 is a schematic showing an effective circuit of FIG. 4.
Figure 6:
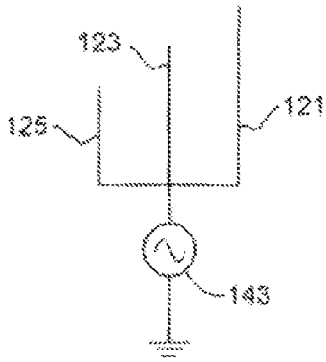
FIGS. 6 and 7 are representations of a plurality of monopole antennas realized by the circuit of FIG. 4.
Figure 7:
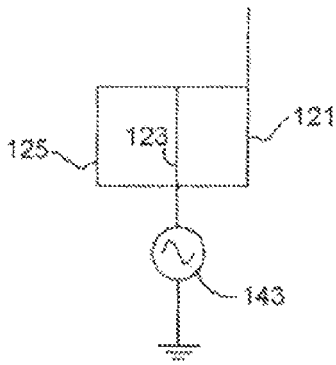

In high-band operation, the capacitor resonates with an inductor that is the equivalent of the trace 117, the trace 119, and the sum of all inductances associated with surrounding traces along the gap length. When this happens, the capacitor and this equivalent inductor together present high impedance and are effectively (virtually) disconnected from the elongated inductor 105 and the traces 121, 123, and 125. This is represented in FIG. 4 by an "X" 145, disconnecting the capacitor and the traces 117 and 119 from the rest of the antenna. The effective circuit that results is shown in FIG. 5. The traces 121, 123, 125, and 105 will behave as a plurality of monopole antennas, as shown in alternate representations in FIGS. 6 and 7.

Figure 8:
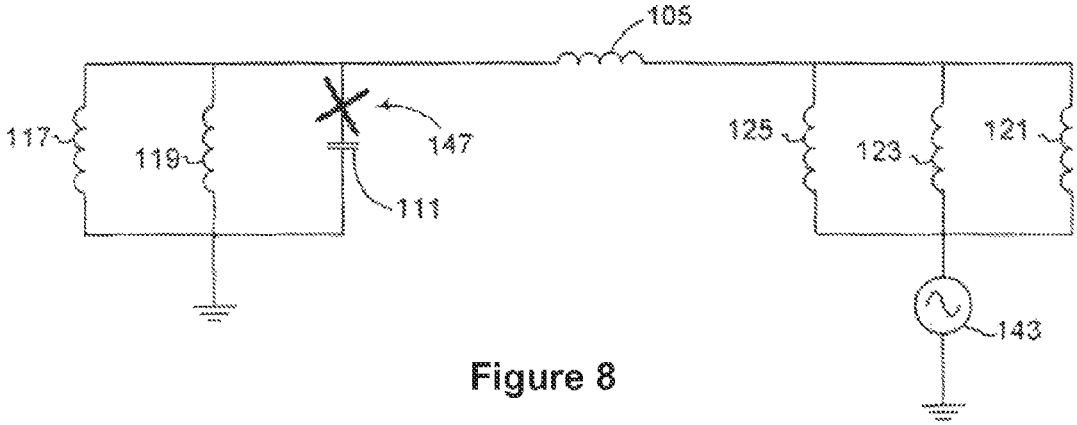
FIG. 8 is a schematic similar to FIG. 3 but showing effects of operation at a relatively low frequency.
Figure 9:
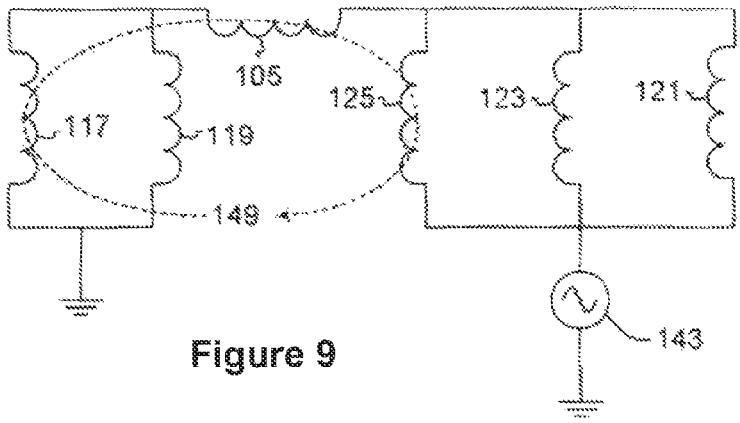
FIGS. 9 through 14 are representations of loop antennas realized by the circuit of FIG. 8.
Figure 10:
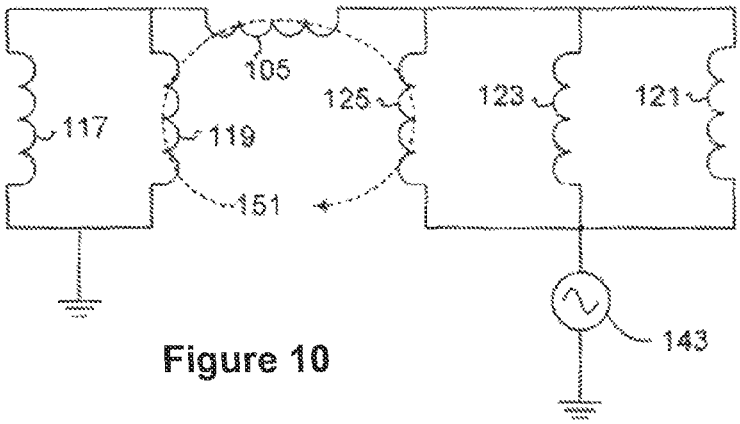
Figure 11:
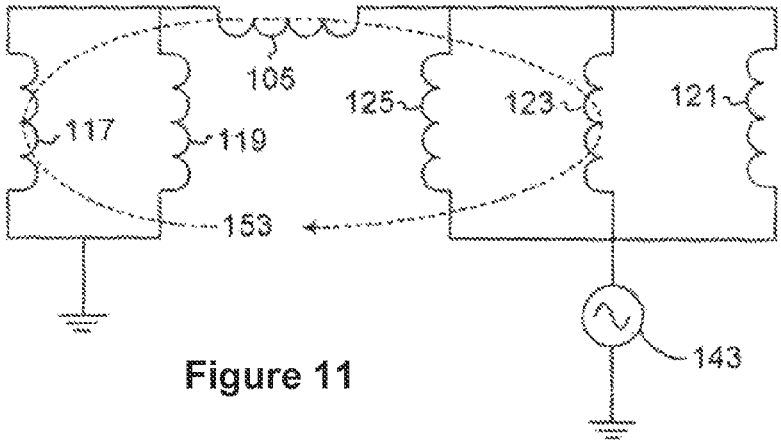
Figure 12:
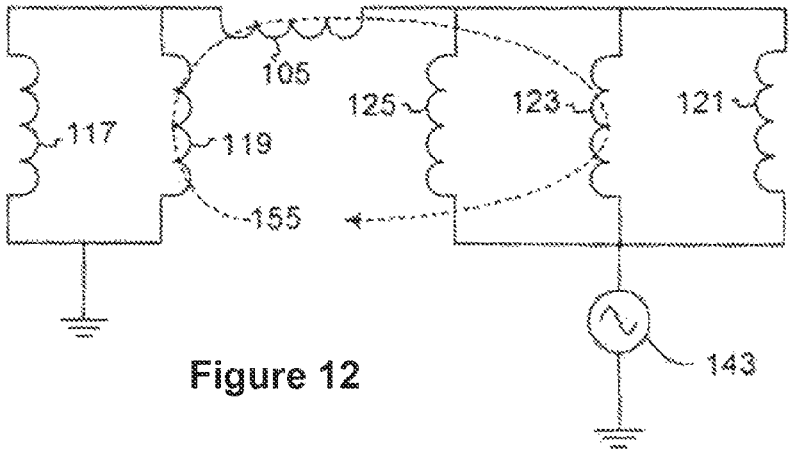
Figure 13:
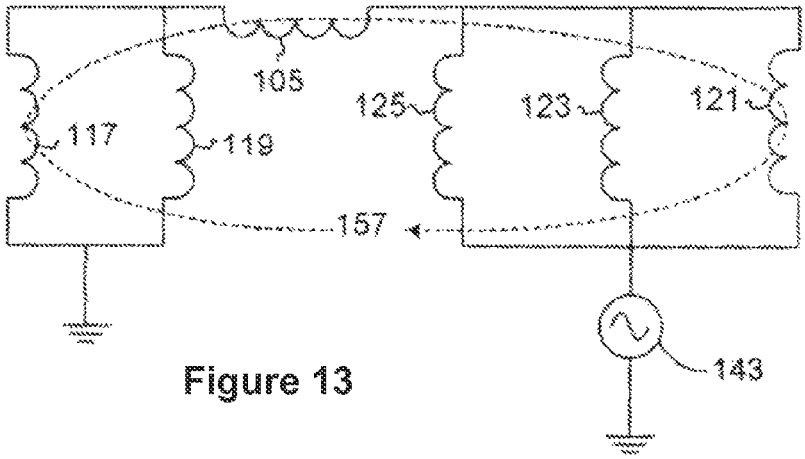
Figure 14:
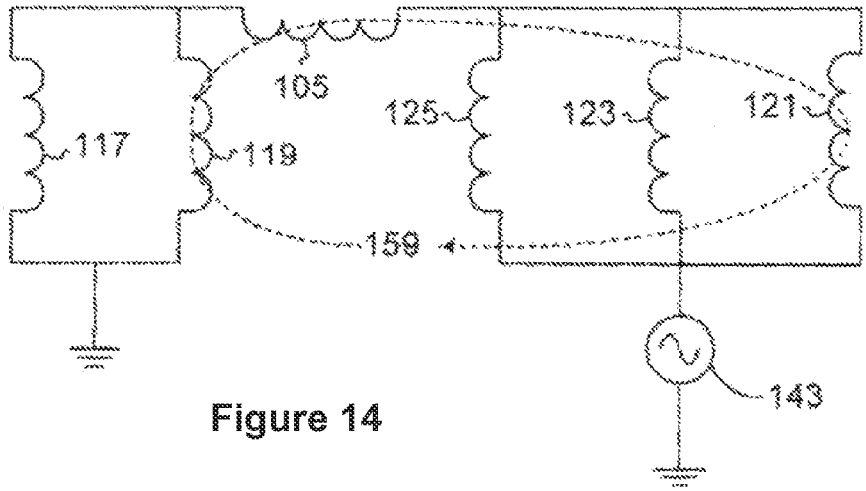

Turning now to FIG. 8, in low-band operation the capacitor is small enough that it plays no significant role. This is represented by an "X" 147 disconnecting the capacitor from the remaining components, being all of the inductors. This combination of inductors defines a plurality of loops as shown in FIGS. 9 through 14. Specifically, a first loop 149 is formed by the traces 117, 105 and 121. A second loop 151 is formed by the traces 119, 105 and 121. A third loop 153 is formed by the traces 117, 105 and 123. A fourth loop 155 is formed by the traces 119, 105 and 123. A fifth loop 157 is formed by the traces 117, 105 and 125. A sixth loop 159 is formed by the traces 119, 105 and 125.

Figure 15:
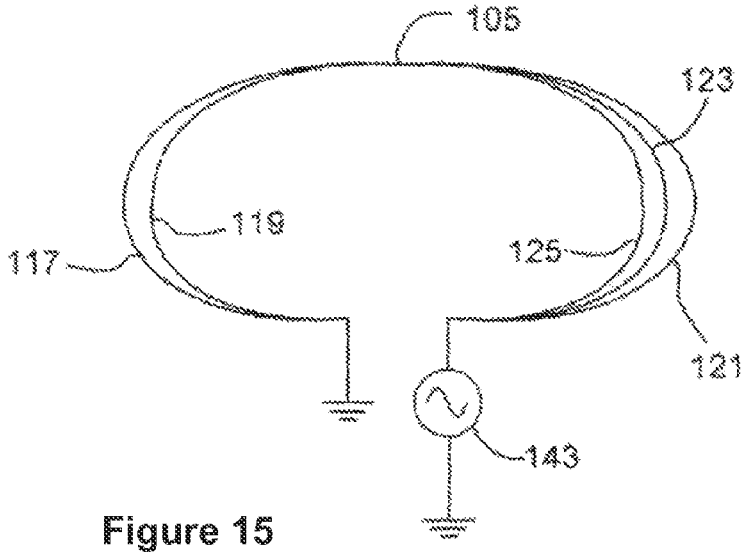
FIG. 15 is a representation of a plurality of loop antennas realized by the circuit of FIG. 8.

The resulting loop antennas that resonate side by side, shown in FIG. 15, result in broad bandwidth in low-band operation.

Figure 16:
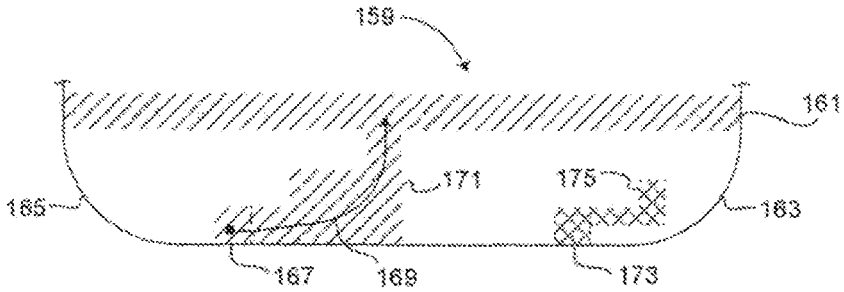
FIG. 16 is a planar view of an end of a printed circuit board on which an antenna according to principles of the invention may be disposed, showing one pattern of ground conductors.

Turning now to FIG. 16, an end 159 of a circuit board is covered by a ground plane 161 except portions 163 and 165 which have no ground plane. A ground pad 167 is positioned for connection of a ground terminal such as the ground terminal 201 of FIG. 1. A conductive path 169 extends from the ground pad to the ground plane through a conductive area 171. A feed pad 173 is positioned for connection of a feed terminal such as the feed terminal 203 of FIG. 1. A conductive area 175 extends from the feed pad to other circuitry (not shown) that drives the antenna in transmit/receive mode.

Figure 17:
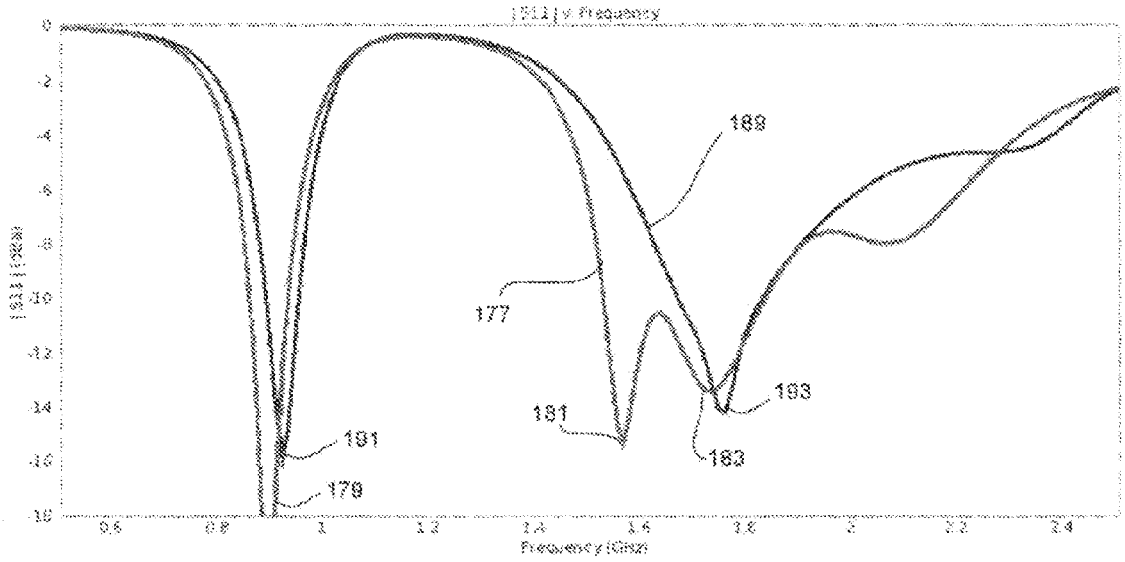
FIG. 17 is a graph showing frequency responses of two different configurations of antennas that embody principles of the invention.

FIG. 17 shows a frequency response curve 177 of an unmatched antenna similar to that shown in FIG. 1 connected to the ground and feed pads. A low resonance 179 occurs at about 0.9 GHz, a middle resonance 181 at about 1.57 GHz, and a high resonance 183 at about 1.75 GHz, and extends to cover UMTS receive band.

Figure 18:
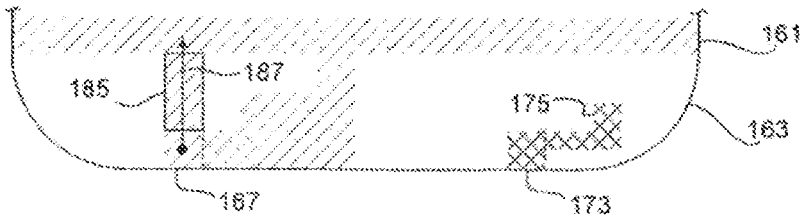
FIG. 18 is a planar view of an end of a printed circuit board on which an antenna according to principles of the invention may be disposed, showing another pattern of ground conductors.

Referring now to FIG. 18, these resonance points can be changed by changing the conductive pattern on the circuit board. For example, a conductive area 185 extends from the ground pad to the ground plane more directly than the conductive area 171, resulting in conductive path 187 that is shorter than the conductive path 169. The effect of this shorter conductive path is shown by a curve 189 in FIG. 17. There are only two resonance points on this curve, a low resonance 191 at about 0.93 GHz and a high resonance 193 at about 1.77 GHz. This technique of changing the length of the conductive path between the ground terminal of the antenna and the ground plane may be used to shift a resonance frequency.

Referring again to FIG. 1, the value of the capacitance per unit length formed between the traces that define the first arcuate inductor 205 and the first common section 214, and the trace that defines the coupling section 217 of the elongated inductor can be changed by making the gap 219 between them larger or smaller. For example, if the gap decreases (capacitance increases), then this capacitor can resonate with smaller inductor values (shorter in length) at the same frequency, assuming no changes have been made to the traces. In this case, the high impedance point shown by "X" in FIG. 4 can be thought of as moving to the left in the drawing, that is, toward the traces 117 and 119 that correspond with the arcuate inductors 205 and 207, respectively. If the gap increases (capacitance decreases), the capacitor will resonate with larger inductor values (longer length) in the same frequency, which pushes the high impedance point to the right. This technique of moving the high impedance point along the length of the elongated conductor 105 in FIGS. 3 and 5 (equivalent to the elongated inductor 215 in FIG. 1), will provide an opportunity to shorten or lengthen the length of the monopoles, tuning the high band resonant frequency without affecting the low band. Changing the value of distributed capacitance can also be achieved by shortening its length, rather than changing its distance from the adjacent trace (gap).

Figure 19:
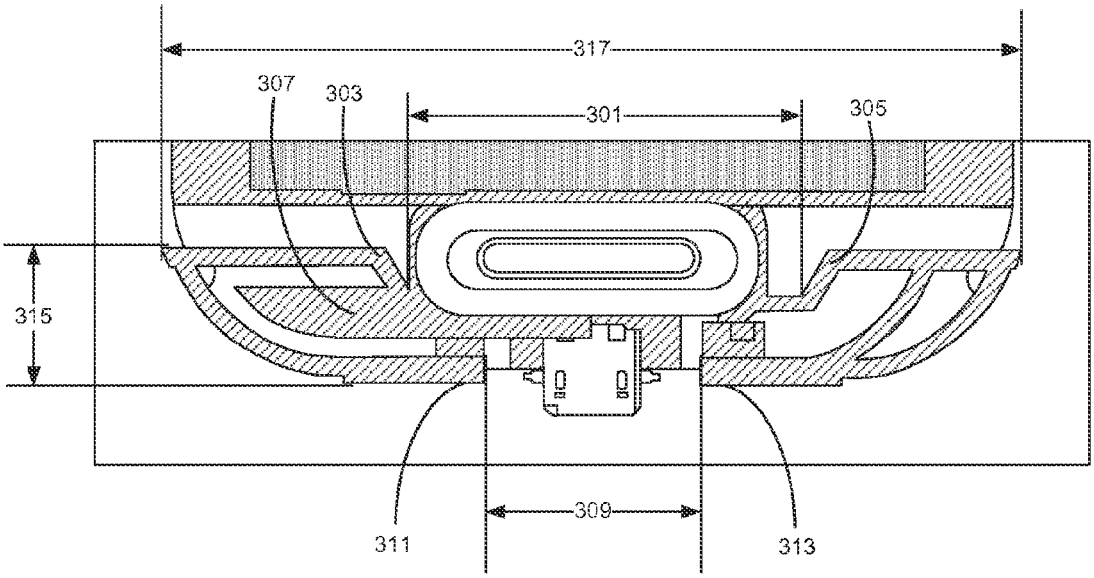
FIG. 19 is a planar view of an antenna embodying principles of the invention and showing approximate dimensions.

Referring to FIG. 19, example dimensions of an antenna similar to the antenna shown in FIG. 1 will now be given. A space 301 between first and second connecting sections 303 and 305 of a conductor 307 is about 29 millimeters. A space 309 between a ground terminal 311 and a feed terminal 313 is about 17 millimeters. A width 315 of the antenna is about 12 millimeters, and a length 317 of the antenna is about 65 millimeters.

Figure 20:
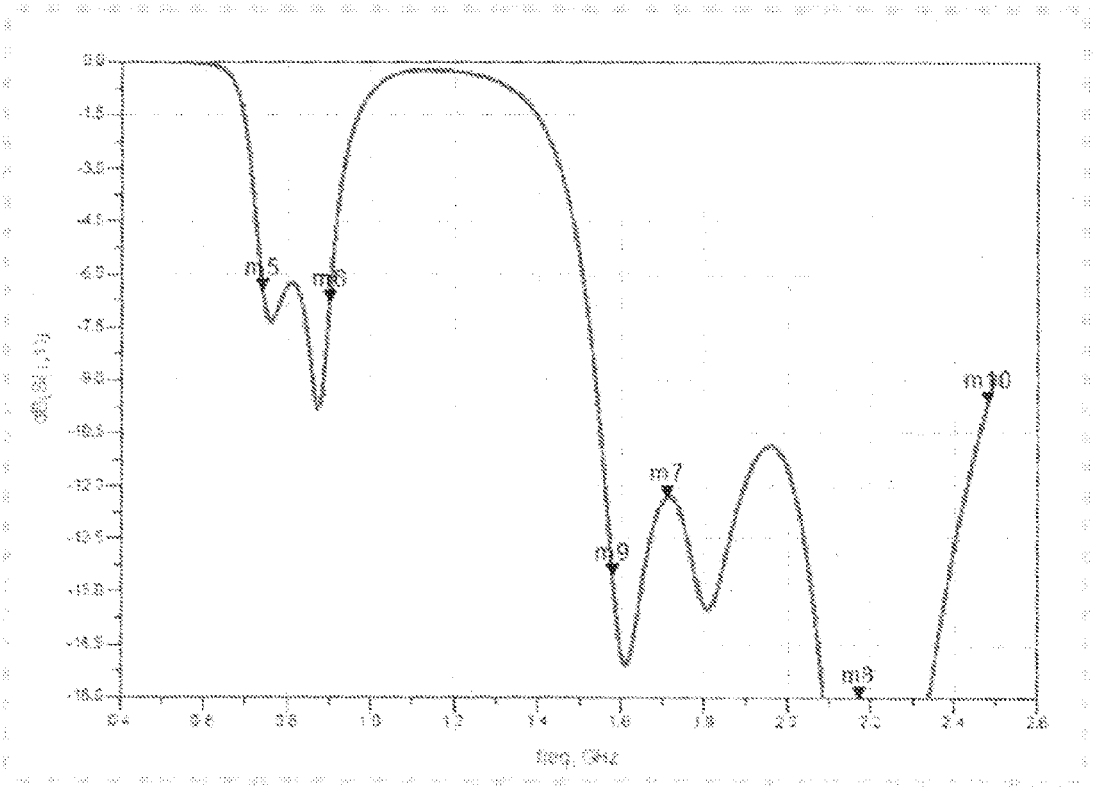
FIG. 20 is a graph similar to FIG. 17 but depicting the frequency response of an embodiment of a matched antenna.

FIG. 20 depicts frequency response of a matched antenna. The values of the points indicated on the graph are:

| Point | Frequency (MHz) | dB(S(1,1)) |
|---|---|---|
| m5 | 740.0 | −6.461 |
| m6 | 900.0 | −6.781 |
| m7 | 1,710 | −12.296 |
| m8 | 2,170 | −30.424 |
| m9 | 1,580 | −14.530 |
| m10 | 2,480 | −9.627 |

An antenna implementing principles of the invention as described above can be fabricated on a printed circuit board and an antenna support, within the confines of a mobile telephone, and provides satisfactory operation in the 700 MHz LTE bands while still covering the 0.85 GHz, 0.90 GHz, and 1.9 GHz frequency bands. It can be tuned by such methods as adjusting the width of the foil traces that form the inductors, adjusting the width of the gap between conductors that forms the capacitor, and adjusting the ground path.

I claim:

1. A broad-band, multi-hand antenna comprising:

a ground terminal and a feed terminal;

an elongated inductor extending between a first connecting section and a second connecting section, wherein a coupling section of the elongated inductor is disposed generally parallel with and spaced apart from one of a first plurality of arcuate inductors to define a gap therebetween:

a first inductive element electrically coupled between the ground terminal and a first extremity of the elongated inductor, wherein the first inductive element comprises the first plurality of arcuate inductors in parallel connection that each have proximal ends connected to the ground terminal and distal ends that define the first connecting section:

a capacitive element in parallel connection with the first inductive element; and a second inductive element electrically coupled between a second extremity of the elongated inductor and the feed terminal, wherein the second inductive element comprises a second plurality of arcuate inductors in parallel connection that each have proximal ends connected to the feed terminal and distal ends that define the second connecting section.

2. The antenna of claim 1 wherein the first connecting section extending from the coupling section defines the first extremity of the elongated inductor, and the second connecting section extending from the coupling section defines the second extremity of the elongated inductor.

3. The antenna of claim 2 wherein the coupling section of the elongated inductor is disposed generally parallel with and spaced apart from the first inductive element to define the capacitive element as a distributed capacitance between the coupling section and the first inductive element.

4. The antenna of claim 3 wherein:

at frequencies falling within a first one of a plurality of bands of the antenna, a high-impedance path is defined between the elongated inductor and the ground terminal by the capacitive element and the first inductive element, whereby the second plurality of arcuate inductors of the second inductive element define monopole radiating elements; and at frequencies falling within a second one of the plurality of bands of the antenna, conducting paths are defined through the first inductive element between the elongated inductor and the ground terminal, whereby each inductor of the first inductive element defines through the elongated inductor defines loop antennas with each inductor of the second inductive element.

5. A broad-band, multi-band antenna comprising:

a circuit board;

a ground plane covering a portion of the circuit board;

a non-conducting frame carried by the circuit board;

a feed terminal carried by the circuit board;

a ground terminal carried by the circuit board and electrically connected to the ground plane;

an elongated inductor carried by the frame extending between a first connecting section and a second connecting section, wherein a coupling section of the elongated inductor is disposed generally parallel with and spaced apart from one of a first plurality of arcuate inductors to define a gap therebetween;

a first inductive element carried by the frame and electrically coupled between the ground terminal and a first extremity of the elongated inductor, wherein the first inductive element comprises the first plurality of arcuate inductors in parallel connection that each have proximal ends connected to the ground terminal and distal ends that define the first connecting section;

a capacitive element defined between the first inductive element and a coupling section. of the elongated inductor; and a second inductive element carried by the frame and electrically coupled between the feed terminal and a second extremity of the elongated inductor, wherein the second inductive element comprises a second plurality of arcuate inductors in parallel connection that each have proximal ends connected to the feed terminal and distal ends that define the second connecting section.

6. The antenna of claim 5 wherein the elongated inductor comprises the first connecting section extending from the coupling section to define the first extremity of the elongated inductor and the second connecting section extending from the coupling section to define the second extremity of the elongated inductor.

7. The antenna of claim 6 wherein:

at frequencies falling within a first one of a plurality of bands of the antenna, a high-impedance path is defined between the elongated inductor and the ground terminal by the capacitive element and the first inductive element, whereby the inductors of the second inductive element define monopole radiating elements; and at frequencies falling within a second one of the plurality of bands of the antenna, conducting paths are defined through the first inductive element between the elongated inductor and the ground terminal, whereby each inductor of the first inductive element defines through the elongated inductor defines loop antennas with each inductor of the second inductive element.

8. A broad-band, multi-band antenna comprising:

a ground terminal;

first and second arcuate inductors having proximal ends connected to the ground terminal and distal ends that define a connecting section;

a feed terminal;

third, fourth and fifth arcuate inductors having proximal ends connected to the feed terminal and distal ends that define a connecting section; and an elongated inductor extending between the connecting section of the first and second arcuate inductors and the connecting section of the third, fourth and fifth arcuate inductors, a coupling section of the elongated inductor disposed generally parallel with and spaced apart from the first arcuate inductor to define a gap therebetween.

9. The antenna of claim 8 and further comprising:

a non-conducting frame;

a circuit board carrying the frame; and a ground plane covering a portion of the circuit board; and wherein the ground terminal is electrically connected to the ground plane, the first and second arcuate inductors are disposed on the frame adjacent the ground plane, and the third, fourth and fifth arcuate elements are disposed on the frame adjacent a portion of the circuit board not covered by the ground plane.

10. The antenna of claim 9 wherein:

a capacitance is formed across the gap;

at frequencies falling within a first one of a plurality of bands of the antenna, a high-impedance path is defined between the elongated inductor and the ground terminal, whereby the third, fourth, and fifth arcuate inductors define monopole radiating elements; and at frequencies falling within a second one of the plurality of bands of the antenna, conducting paths are defined through the first and second arcuate inductors between the elongated inductor and the ground terminal, whereby the first arcuate inductor through the elongated inductor defines loop antennas with each of the third, fourth, and fifth arcuate inductors and the second arcuate inductor through the elongated inductor defines loop antennas with each of the third, fourth, and fifth arcuate inductors.

* * * * *